United States Patent [19]

Handa

[11] Patent Number: 5,074,545

[45] Date of Patent: Dec. 24, 1991

[54] DEVICE FOR PREVENTING THE TRANSPORT OF POORLY ALIGNED COPY PAPER

[75] Inventor: Tamami Handa, Nara, Japan

[73] Assignee: Sharp Kabushiki Kaisha, Osaka, Japan

[21] Appl. No.: 664,502

[22] Filed: Mar. 5, 1991

Related U.S. Application Data

[63] Continuation of Ser. No. 545,774, Jun. 29, 1990, abandoned, which is a continuation of Ser. No. 819,024, Jan. 15, 1986, abandoned.

[30] Foreign Application Priority Data

Jan. 22, 1985 [JP] Japan ..... 60-7839[U]

[51] Int. Cl.[5] ..... B65H 7/08

[52] U.S. Cl. ..... 271/227; 271/236; 271/245; 271/258

[58] Field of Search ..... 271/226, 227, 245, 246, 271/258, 265, 235, 236

[56] References Cited

U.S. PATENT DOCUMENTS

| | | | |
|---|---|---|---|
| T102,003 | 7/1982 | Bullock | 271/227 |
| 1,908,845 | 5/1933 | Hopkins | 271/227 |
| 2,428,769 | 10/1947 | Bobst | 271/227 |
| 2,433,120 | 12/1947 | Harrold | 271/258 |
| 3,356,364 | 12/1967 | Grigereit | 271/245 X |
| 3,888,478 | 6/1975 | Alderman, Jr. et al. | 271/245 |
| 4,638,989 | 1/1987 | Senoo | 271/227 |

FOREIGN PATENT DOCUMENTS

| | | | |
|---|---|---|---|
| 1146074 | 8/1960 | Fed. Rep. of Germany . | |
| 2127384 | 4/1984 | United Kingdom | 271/227 |

*Primary Examiner*—Richard A. Schacher

[57] ABSTRACT

A device suitable for an electrophotographic copying machine which comprises a detection bar for detecting the transport of a copy paper and causing its pivotal movement by being pushed by the front side of the copy paper, a plurality of paper prevention claws responsive to the position of the detection bar for selectively allowing the transport of the copy paper and, otherwise, preventing the transport of the copy paper, and a rotatable shaft for coaxially coupling the detection bar with the paper prevention claws. According to the pivotal movement of the detecton bar, the rotatable shaft can be rotated to thereby rotate and lift the plurality of paper prevention claws.

3 Claims, 1 Drawing Sheet

DEVICE FOR PREVENTING THE TRANSPORT OF POORLY ALIGNED COPY PAPER

This application is a continuation of application Ser. No. 07/545,774, filed on June 29, 1990 which was a continuation of application Ser. No. 06/819,024 filed on Jan. 15, 1986, both now abandoned.

BACKGROUND OF THE INVENTION

The present invention relates to a copy-paper incorrect transport prevention device and, more particularly, to a device suitable for an electrophotographic copying machine that prevents a copy paper from being transported whenever a condition occurs in the transport operation that may jam the copy paper.

The conventional electrophotographic copying machine transport copy papers to the image generation portion, which forms pictures on the copy papers before ejecting them from the copying machine. The copy papers are transported to the image generation portion through the copy-paper transport path by conveyer rollers. Conventionally, detection means such as microswitches are provided for sensing the position and condition of the copy paper in the paper-transport path. In response to the information gathered from the microswitches, the drive train of the conveyer rollers is controlled so that the copy papers can be securely transported to the image generation portion.

Because of the complicated construction of the conventional paper detection and prevention device, it is now desired that an improved prevention device for exactly detecting the poorly aligned transport of the copy papers be one of simple construction.

SUMMARY OF THE INVENTION

Accordingly, it is an object of the present invention to provide an improved prevention device for preventing a copy paper from being transported whenever it is poorly aligned.

It is another object of the present invention to provide an improved prevention device suitable for an electrophotographic copying machine for accurately preventing a copy paper from being transported when poorly aligned.

Briefly described, in accordance with the present invention, a device suitable for an electrophotographic copying machine comprises a detection bar means for detecting the transport of a copy paper and causing its pivotal movement by being pushed by the front side of the copy paper, a paper prevention means responsive to the position of the detection bar means for selectively allowing the transport of the copy paper, and otherwise preventing the transport of the copy paper, and shaft means for coaxially coupling the detection bar means with the paper prevention means. According to the pivotal movement of the detection means, the shaft means can be rotated to thereby rotate and lift the paper prevention means.

BRIEF DESCRIPTION OF THE DRAWINGS

The present invention will become more fully understood from the detailed description given hereinbelow and the accompanying drawings which are given by way of illustration only, and thus are not intend to limit the present invention and wherein.

DESCRIPTION OF THE INVENTION

Figure 1:
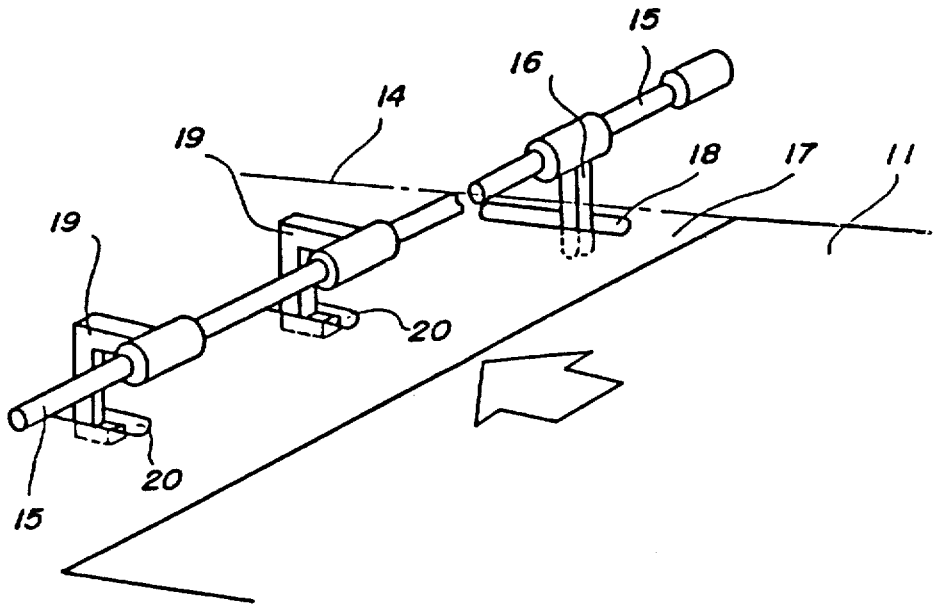
FIG. 1 is a perspective view of a paper prevention device for an electrophotographic copying machine according to the present invention.
Figure 2:
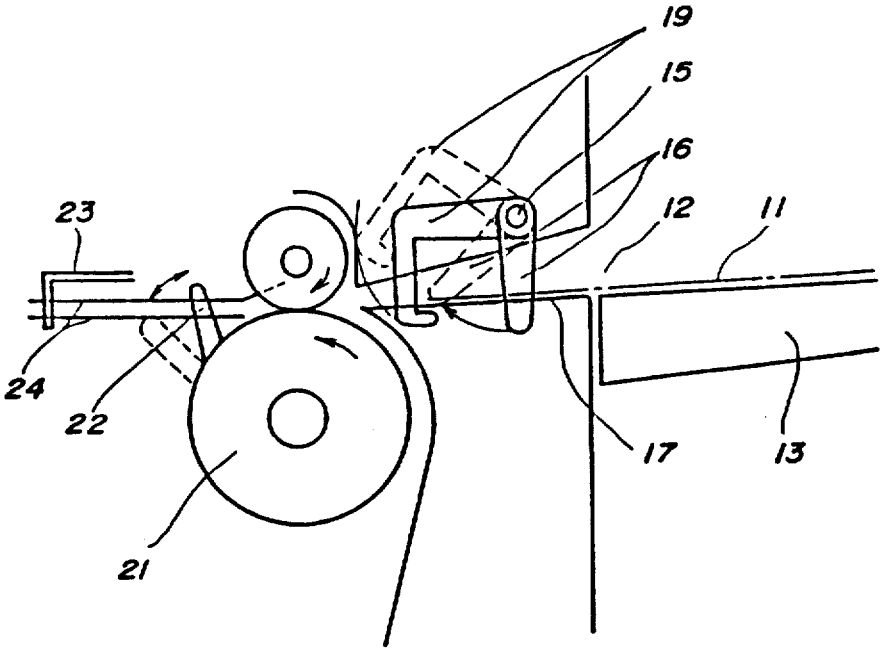
FIG. 2 is a side sectional view of the paper prevention device of FIG. 1.

FIG. 1 is a perspective view of a paper prevention device for an electrophotographic copying machine according to the present invention. FIG. 2 is a side sectional view of the device of FIG. 1.

Referring now to FIGS. 1 and 2, in the paper prevention device for the copying machine of the present invention, a paper such as a copy paper is inserted in through a paper inlet 12 disposed on a paper supply plate 13. The copy paper 11 is transported in with its one side being in contact with a reference edge 14 as one side of the prevention device. Beside the paper inlet 12, a detection bar 16 is provided for detecting the insertion of one copy paper. The pivotal movement of bar 16 is caused by contact with the front side of a copy paper. One end of the bar 16 is fixed to a rotatable shaft 15. The other free end of the detection bar 16 can be positioned within an opening 18 formed in a guide plate 17 carrying the copy paper thereon. When the copy paper 11 is inserted with its side being in contact with the reference edge 14, the free end of the detection bar 16 can swing around the rotatable shaft 15 by being pushed by the front side of the paper 11, so that the rotatable shaft 15 can rotate clockwise.

Two poor-alignment prevention claws 19 are coupled to the rotatable shaft 15 for preventing a copy paper 11 from being transported when the side of the copy paper is too far from the reference edge 14. The claws 19 are coaxial with the detection bar 16 in that both are fixed on the rotatable shaft 15. Each of the free ends of the prevention claws 19 is inserted into each of apertures 20 in the guide plate 17. The prevention claws 19 are shaped as "L" such that the detection bar 16 should positioned closer to the front end of the traveling copy paper rather than the prevention claws 19. Therefore, the front end of the traveling copy paper is firstly opposed to the detection bar 16 and second to the prevention claws 19. When the copy paper 11 is inserted in, the detection bar 16 first can be swung by being pushed by the front side of the paper 11, so that the rotatable shaft 15 can be rotated and the prevention claws 19 are second able to separate from the apertures 20 in the guide plate 17, whereby the prevention means of the insertion of the travelling copy paper is released.

Connection means are provided at the end of the rotatable shaft 15. Upon the rotation of the rotatable shaft 15, the connection means cause microswitches to be switched ON or OFF. When the copy paper 11 is inserted in, the detection bar 16 can swing to permit the rotatable shaft 15 to be rotated, to thereby switch the microswitches ON or OFF in order to detect the presence of the copy paper. According to the paper detection, a pair of paper feeding rollers 21 can be rotated. They are positioned at the inner portion of the paper detection portion, following the guide plate 17. The pair of paper feeding rollers 21 comprise a driving roller positioned below the guide plate 17 and a follower positioned above the guide plate 17. This follower roller can be stressed toward the driving roller with its weight. Behind the pair of paper feeding rollers 21, an operation lever 22 of another paper transportion detection means is provided. The lever 22 can rise on the transport way. When the lever 22 becomes upright, the copying operation starts.

A stopper plate 23 is provided for stopping the front edge of the paper forwarded between upper and lower guide plate 24 so as to stop the transport of the paper.

The stopper paper 23 serves to intermittently stop the transport of the paper 11 and start to transport it in synchronization with the revolution of the photoreceptor. The stopping means of the paper is released when the transport starts. According to the synchronization signal, the stopper plate 23 is removed from the transport path in order to start the paper. In accordance with the driving of the pair of paper feed rollers 21, the paper transport is resumed.

In the paper guide system as described above, when the paper 11 is intended to be supplied manually, such a paper should be supplied through the paper inlet 12 on the paper supply plate 13. In so far as one side of the paper 11 under transport is inserted along the reference edge 14, the detection bar 16 should rotate as shown in the broken line of FIG. 2. The rotation shaft 15 is thereby rotated clockwise since the detection bar 16 is coupled to the shaft 15. The prevention claws 19 are also rotated and lifted as shown in the broken line of FIG. 2 since they are fixed to the rotatable shaft 15. Thus, when the paper 11 is inserted along the reference edge 14, the detection bar 16 and the prevention clause 19 are rotated out of the path of the paper. The paper 11 can be transported into the pair of paper feed rollers 21. When the detection bar 16 rotates at the position as indicated in the broken line of FIG. 2, the relevant microswitch means are activated through the connection means, so that the insertion of the paper 11 can be detected and the rotation of the paper feed rollers 21 is started.

The paper 11 is grasped by the pair of rollers 21, so that the paper can be transported. The paper 11 pushes the operation lever 22 behind the rollers 21 and the copying operations are now started. When the front side of the paper 11 reaches the stopper plate 23, the paper is stopped. Under the circumstances, the synchronization signal of the photoreceptor is provided for removing the stopper plate 23 from the paper transport path, so that the transport of the paper 11 is resumed and it is transported into the image formation unit of the copying machine. An accurate image can be transferred to the paper 11.

When the paper 11 is inserted into the paper copy path without being aligned along the reference edge 14 such that it bypasses the detection bar 16, the bar will not rotate because the paper 11 will not contact the bar 16. Bar 16 remains being positioned at the solid line of FIG. 2. Therefore, the prevention claws 19 remain being within the apertures 20 of the guide plate 17. As soon as the paper 11 is transported toward the claws 19, the front side of the paper 11 can be prevented from being transported by the lower portions of the prevention claws 19. While rotatable shaft 15 may be somewhat rotated, the microswitch means cannot be activated. Thus, the paper transport can be prevented.

In the above description, the paper prevention device is positioned near the paper manually-inserted inlet to detect and stop the poorly aligned paper. Needless to say, it may be preferred that the present paper prevention device is positioned near the paper auto-inserted inlet and, further, inside the copying machine to detect and stop the paper under incorrect transport. It is essential that the paper transport can be prevented when it is poorly aligned before it reaches the conveyer means such as the rollers 21 or the belt means. The detection bar 16 is positioned at the edge portion of the rotatable shaft 15 so as to detect the transport condition of the paper which is inserted with one side being along the reference edge 14. Therefore, if the detection bar 16 is positioned at the center of the length of the rotatable shaft 15, it can detect the transport condition of the paper which is inserted with its center being centered in the transport path. In this situation the detection bar 16 would be rotated by being push by the front side of the paper under transport.

According to the feature of the present invention, the poorly aligned paper can be stopped. Because the detection bar 16 and the prevention claws 19 are provided as being coaxial in connection with the rotatable shaft 15, the release of the paper prevention by the prevention claws 19 is enabled only when the detection bar is rotated by being push by the front side of the paper, so that accurate paper detection and prevention can be expected with the simple construction of the paper prevention device.

It is not necessary for the number of the paper prevention claws to be two. A single claw can afford the function of the paper prevention.

While only certain embodiments of the present invention have been described, it will be apparent to those skilled in the art that various changes and modifications may be made therein without departing from the spirit and scope of the present invention as claimed.

What is claimed is:

1. A paper detection device for preventing the incorrect transport of copy paper along a transport path comprising:

a transport path for transporting paper thereon in a forward direction;

a rotatable shaft extending across said transport path;

paper detection means comprising a detection lever supported in an unrotatable manner by said rotatable shaft, wherein a free end of said detection lever is located within the transport path in a perpendicular manner at a first detection position which is offset from the center of said transport path, said detection lever moving to a second detection position out of said transport path and causing said rotatable shaft to rotate when a front edge of properly aligned paper being transported in a forward direction on said transport path pushes said detection lever to said second detection position; and paper prevention means comprising at least one right angle lever supported in an unrotatable manner by said rotatable shaft, said right angle lever having an arm portion which extends from said rotatable shaft parallel to said forward direction and claw portion which extends into said transport path in a perpendicular manner at a first prevention position which is located forward of said detection lever in said first detection position, wherein contact by a front edge of paper properly aligned on said transport path causes said paper detection means to move to said second detection position thereby causing said rotatable shaft to rotate and said paper prevention means to move to a second prevention position out of said transport path, and wherein paper improperly aligned on said transport path which fails to contact said paper detection means is prevented from being transported past said paper prevention means which remains in said first prevention position.

2. The device of claim 1, wherein said paper prevention means comprises a plurality of right angle levers unrotatably fixed to said rotatable shaft means in said transport path.

3. An electrophotographic copying machine inclusive of a device for preventing the incorrect transport of copy paper along a transport path within said copying machine as defined in claim 1.

* * * * *